US006315702B1

(12) United States Patent
Ikonomopoulos

(10) Patent No.: US 6,315,702 B1
(45) Date of Patent: Nov. 13, 2001

(54) EXERCISE MACHINE

(76) Inventor: Anna Ikonomopoulos, 47 Saint Johns Pl., Keansburg, NJ (US) 07734

( * ) Notice: Subject to any disclaimer, the term of this patent is extended or adjusted under 35 U.S.C. 154(b) by 0 days.

(21) Appl. No.: 09/506,569

(22) Filed: Feb. 18, 2000

(51) Int. Cl.[7] ..... A63B 21/062

(52) U.S. Cl. ..... 482/138; 482/52; 482/100; 482/103; 482/142

(58) Field of Search ..... 482/51, 52, 100, 482/103, 136–138, 142

(56) References Cited

U.S. PATENT DOCUMENTS

| | | | | |
|---|---|---|---|---|
| D. 367,900 | | 3/1996 | Hu . | |
| 2,932,509 | | 4/1960 | Zinkin . | |
| 4,793,608 | | 12/1988 | Mahnke et al. . | |
| 4,804,179 | * | 2/1989 | Murphy et al. | 482/138 |
| 4,919,419 | * | 4/1990 | Houston | 482/138 |
| 5,236,406 | | 8/1993 | Webber . | |
| 5,263,915 | * | 11/1993 | Habing | 482/99 |
| 5,324,246 | * | 6/1994 | Wang | 482/133 |
| 5,330,405 | | 7/1994 | Habing et al. . | |
| 5,419,751 | * | 5/1995 | Byrd et al. | 482/138 |
| 5,716,308 | | 2/1998 | Lee . | |
| 5,722,922 | * | 3/1998 | Watterson et al. | 482/136 |

* cited by examiner

*Primary Examiner*—Mickey Yu
*Assistant Examiner*—Victor K. Hwang

(57) ABSTRACT

A exercise machine for providing an efficient total body work out. The exercise machine includes a base. A first vertical column attached to the middle of base. A second vertical column attached to the base. A guide column extends vertically from the base between the first and second columns. A set of foot pedals attached adjacent to the second column. A first set of two elongate bars is mounted to the first column. A second set of two elongate bars is mounted to the first column. Two solid tubes extend diametrically from a mounting and bend toward each other to a parallel position. A first pulley is attached to an apex of the second column, and the second pulley is attached to the first column. A plurality of the weights is housed on the guide column. The weights are removably coupled to the guide column. An anchor is linked to the pulleys by a cable. The anchor is made up of a first disc and a second disc. The cable is secured to the first disc and slides through the second disc. The discs each have a bore therethrough. A plurality of pins, in sets of two, wherein a first pin remains motionless during movement of the apparatus and a second pin has movement in a direction parallel to the apparatus. The pins are located on the foot pedals, first set of elongate bars, and second set of elongate bars.

12 Claims, 7 Drawing Sheets

37
27

27
35
36
28
34

50
52
51
54
51
54
53

EXERCISE MACHINE

BACKGROUND OF THE INVENTION

1. Field of the Invention

The present invention relates to exercise machines and more particularly pertains to a new exercise machine for providing an efficient total body work out.

2. Description of the Prior Art

The use of exercise machines is known in the prior art. More specifically, exercise machines heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,236,406; 4,793,608; 5,716,308; 5,330,405; U.S. Des. Pat. No. 367,900; and U.S. Pat. No. 2,932,509.

While these devices fulfill their respective, particular objectives and requirements, the aforementioned patents do not disclose a new exercise machine. The inventive device includes a base. The base has a distal end, a proximal end, and a middle portion. A first vertical column is fixedly attached to the middle portion of the base. A second vertical column is fixedly attached to the base. The second column is located between the distal end of the base and the first column to form a space between the first and second columns. A guide column extends vertically from the base between the first column and the second column. A set of foot pedals is hingedly attached to the second column and extends outwardly toward the distal end of the base. A first set of two elongate bars is adjustably mounted to the first column. The bars each have a handle. A second set of two elongate bars is adjustably mounted to the first column. Two solid tubes extend diametrically from a mounting means. The tubes bend toward each other to a parallel position. The mounting means is adapted to be mounted to the second column. A pulley means is comprised of a first pulley and a second pulley. The first pulley is fixedly attached to an apex of the second column, and the second pulley is attached to the first column. A plurality of weights each have a bore therethrough. Each of the weights is housed on the guide column whereby the guide column travels through the bores in the weights. The weights are removably coupled to the guide column. An anchor is linked to the pulley means by a cable. The anchor is comprised of a first disc and a second disc. The cable is secured to the first disc and slides through the second disc. The discs each have a bore therethrough to receive a pin. A plurality of pins are comprised in sets of two wherein a first pin remains motionless during movement of the apparatus and wherein a second pin has movement in a direction parallel to the apparatus. The pins are located on the foot pedals, first set of elongate bars, and second set of elongate bars.

In these respects, the exercise machine according to the present invention substantially departs from the conventional concepts and designs of the prior art, and in so doing provides an apparatus primarily developed for the purpose of providing an efficient total body work out.

SUMMARY OF THE INVENTION

In view of the foregoing disadvantages inherent in the known types of exercise machines now present in the prior art, the present invention provides a new exercise machine construction wherein the same can be utilized for providing an efficient total body work out.

The general purpose of the present invention, which will be described subsequently in greater detail, is to provide a new exercise machine apparatus and method which has many of the advantages of the exercise machines mentioned heretofore and many novel features that result in a new exercise machine which is not anticipated, rendered obvious, suggested, or even implied by any of the prior art exercise machines, either alone or in any combination thereof.

To attain this, the present invention generally comprises a base. The base has a distal end, a proximal end, and a middle portion. A first vertical column is fixedly attached to the middle portion of the base. A second vertical column is fixedly attached to the base. The second column is located between the distal end of the base and the first column to form a space between the first and second columns. A guide column extends vertically from the base between the first column and the second column. A set of foot pedals is hingedly attached to the second column, each foot pedal extending in the direction of the distal end of the base. A first set of two elongate bars is adjustably mounted to the first column. The bars each have a handle. A second set of two elongate bars is adjustably mounted to the first column. Two solid tubes extend diametrically from a mounting means. The tubes bend toward each other to a parallel position. The mounting means is adapted to be mounted to the second column. A pulley means is comprised of a first pulley and a second pulley. The first pulley is fixedly attached to an apex of the second column, and the second pulley is attached to the first column. A plurality of weights each have a bore therethrough. Each of the weights is housed on the guide column whereby the guide column travels through the bores in the weights. The weights are removably coupled to the guide column. An anchor is linked to the pulley means by a cable. The anchor is comprised of a first disc and a second disc. The cable is secured to the first disc and slides through the second disc. The discs each have a bore therethrough to receive a pin. A plurality of pins are comprised in sets of two wherein a first pin remains motionless during movement of the apparatus and wherein a second pin has movement in a direction parallel to the apparatus. The pins are located on the foot pedals, first set of elongate bars, and second set of elongate bars.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new exercise machine apparatus and method which has many of the advantages of the exercise machines mentioned heretofore and many novel features that result in a new exercise machine which is not anticipated, rendered obvious, suggested, or even implied by any of the prior art exercise machines, either alone or in any combination thereof.

It is another object of the present invention to provide a new exercise machine which may be easily and efficiently manufactured and marketed.

It is a further object of the present invention to provide a new exercise machine which is of a durable and reliable construction.

An even further object of the present invention is to provide a new exercise machine which is susceptible of a low cost of manufacture with regard to both materials and labor, and which accordingly is then susceptible of low prices of sale to the consuming public, thereby making such exercise machine economically available to the buying public.

Still yet another object of the present invention is to provide a new exercise machine which provides in the apparatuses and methods of the prior art some of the advantages thereof, while simultaneously overcoming some of the disadvantages normally associated therewith.

Still another object of the present invention is to provide a new exercise machine for providing an efficient total body work out.

Yet another object of the present invention is to provide a new exercise machine which includes a base. The base has a distal end, a proximal end, and a middle portion. A first vertical column is fixedly attached to the middle portion of the base. A second vertical column is fixedly attached to the base. The second column is located between the distal end of the base and the first column to form a space between the first and second columns. A guide column extends vertically from the base between the first column and the second column. A set of foot pedals is hingedly attached to the second column adjacent to the ground and extend in the direction of the distal end of the base. A first set of two elongate bars is adjustably mounted to the first column. The bars each have a handle. A second set of two elongate bars is adjustably mounted to the first column. Two solid tubes extend diametrically from a mounting means. The tubes bend toward each other to a parallel position. The mounting means is adapted to be mounted to the second column. A pulley means is comprised of a first pulley and a second pulley. The first pulley is fixedly attached to an apex of the second column, and the second pulley is attached to the first column. A plurality of weights each have a bore therethrough. Each of the weights is housed on the guide column whereby the guide column travels through the bores in the weights. The weights are removably coupled to the guide column. An anchor is linked to the pulley means by a cable. The anchor is comprised of a first disc and a second disc. The cable is secured to the first disc and slides through the second disc. The discs each have a bore therethrough to receive a pin. A plurality of pins are comprised in sets of two wherein a first pin remains motionless during movement of the apparatus and wherein a second pin has movement in a direction parallel to the apparatus. The pins are located on the foot pedals, first set of elongate bars, and second set of elongate bars.

Still yet another object of the present invention is to provide a new exercise machine that gives a total body workout allowing the user to use the movable features in opposite directions to provide a greater number of exercises.

Even still another object of the present invention is to provide a new exercise machine that provides discs which allow easy manipulation of the apparatus' functions.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
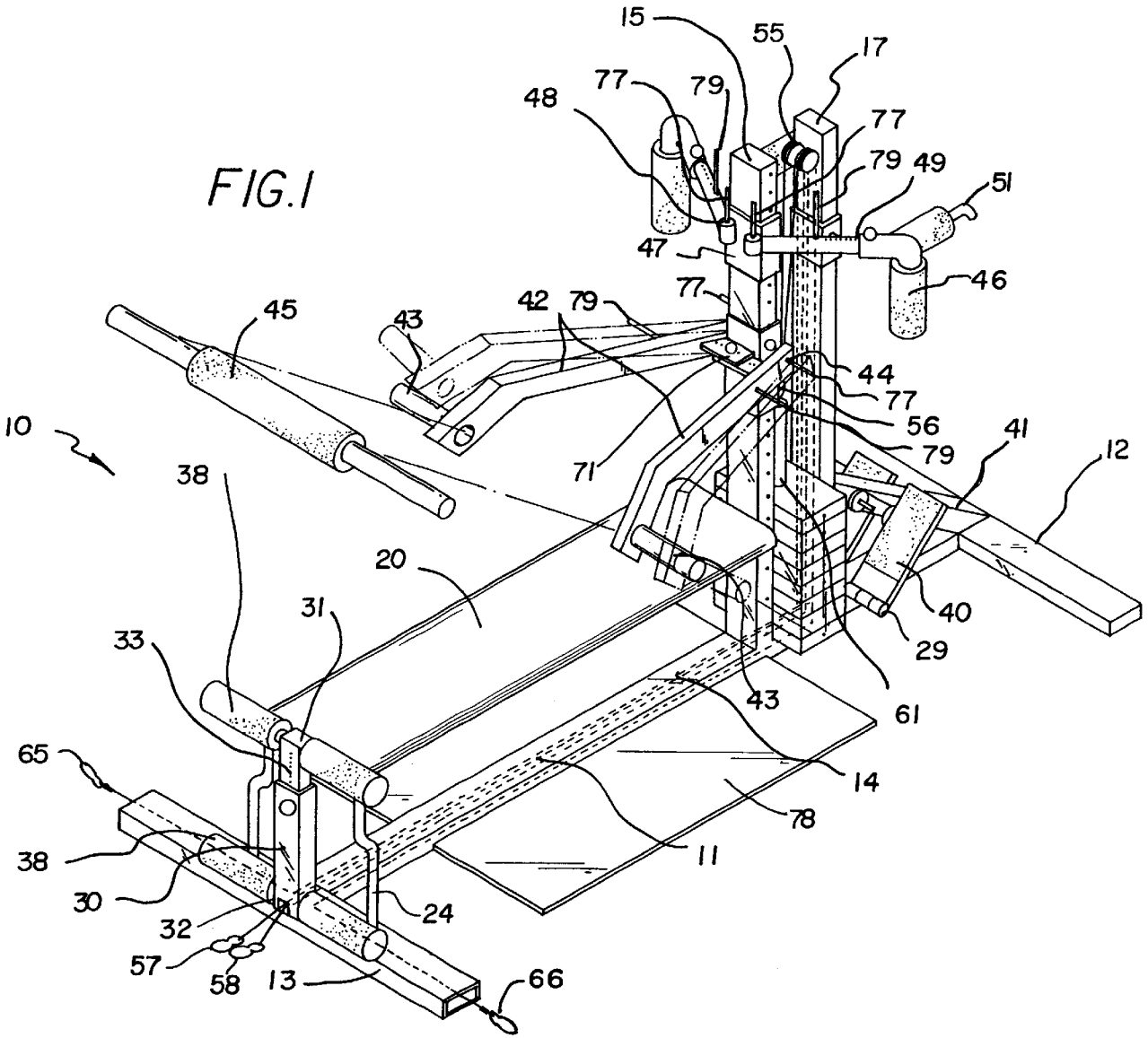
FIG. 1 is a schematic perspective view of a new exercise machine according to the present invention.
Figure 2:
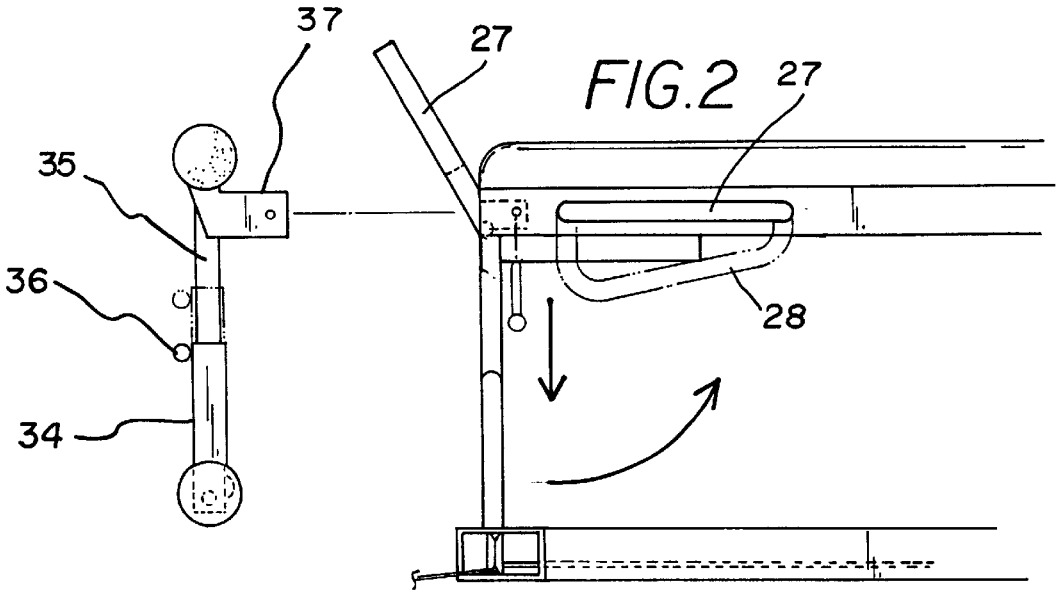
FIG. 2 is a schematic side view of the present invention.
Figure 3:
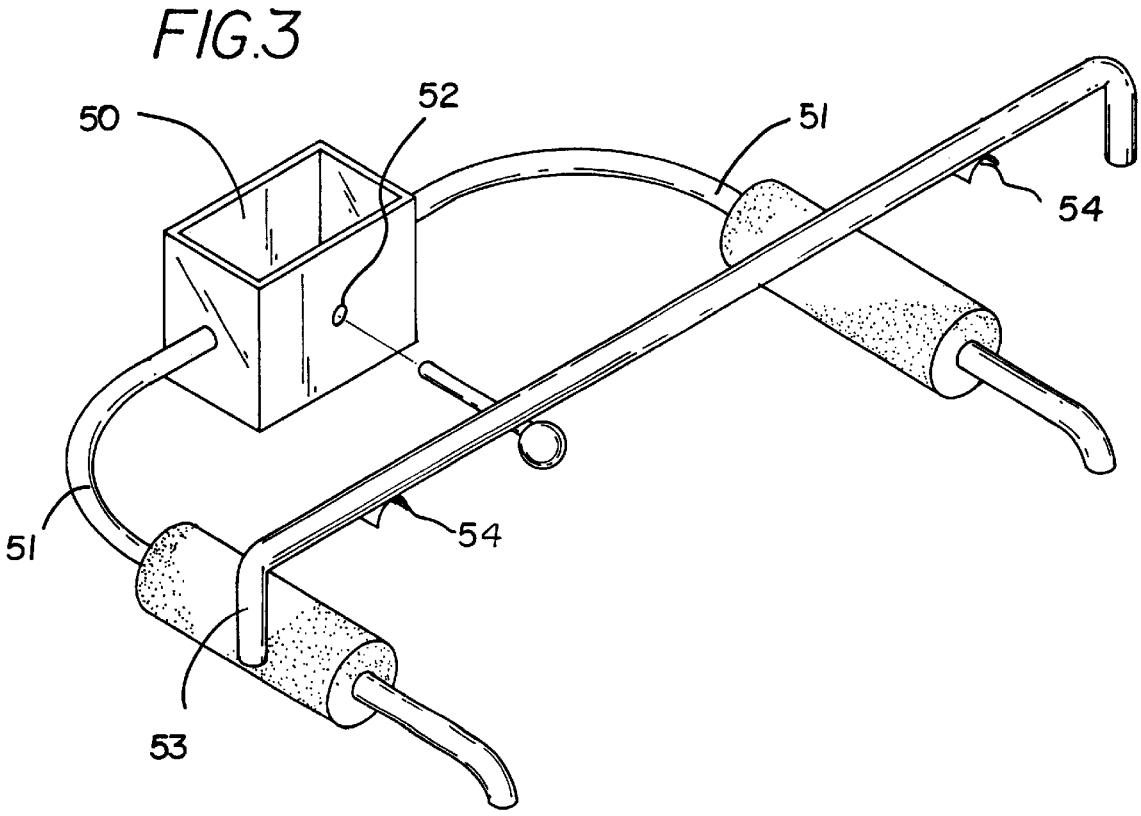
FIG. 3 is a schematic perspective view of a bar assembly on the second column of the present invention.
Figure 4:
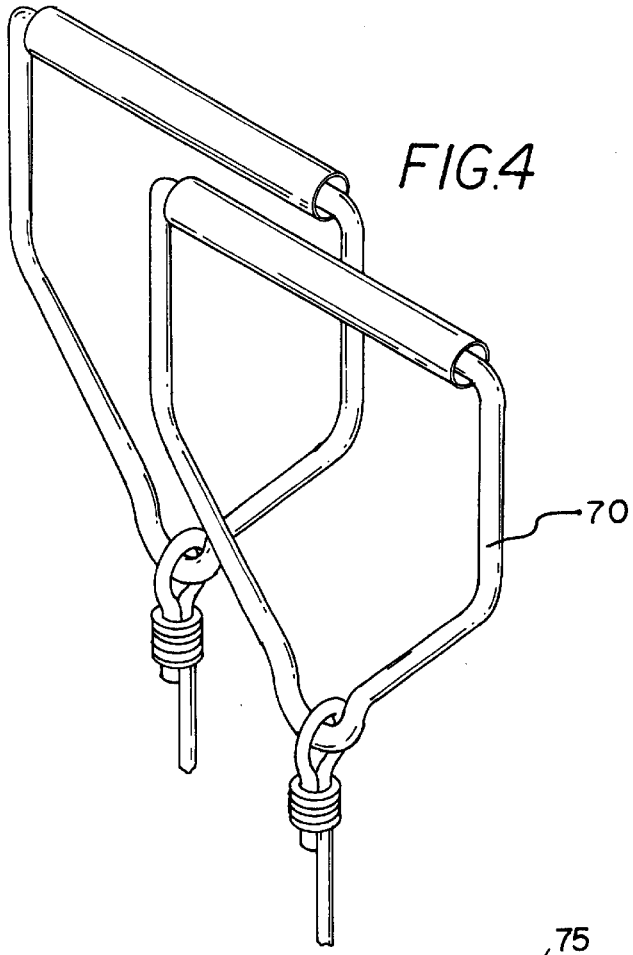
FIG. 4 is a schematic perspective view of handles of the present invention.
Figure 5:
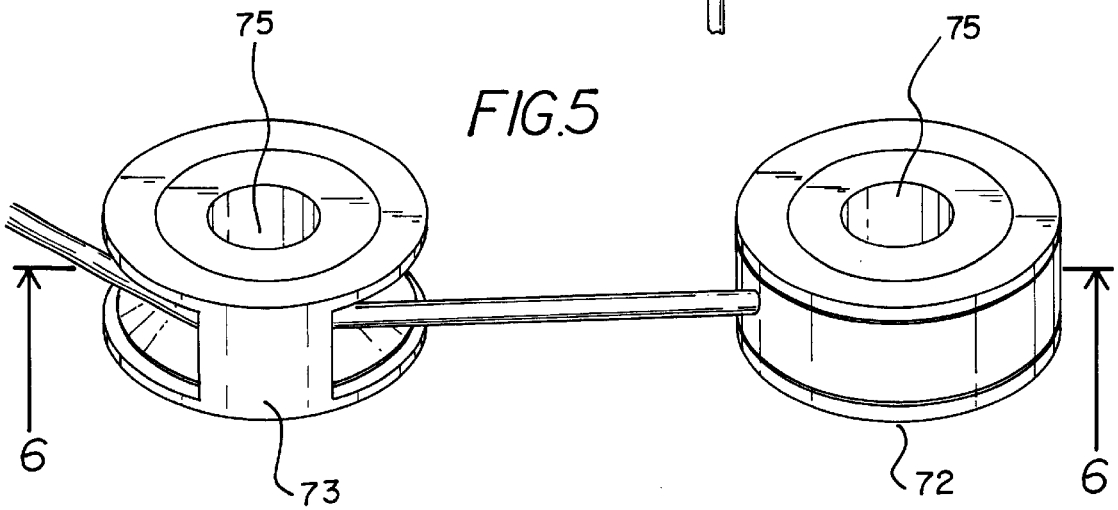
FIG. 5 is a schematic perspective view of the anchors and weights of the present invention.
Figure 6:
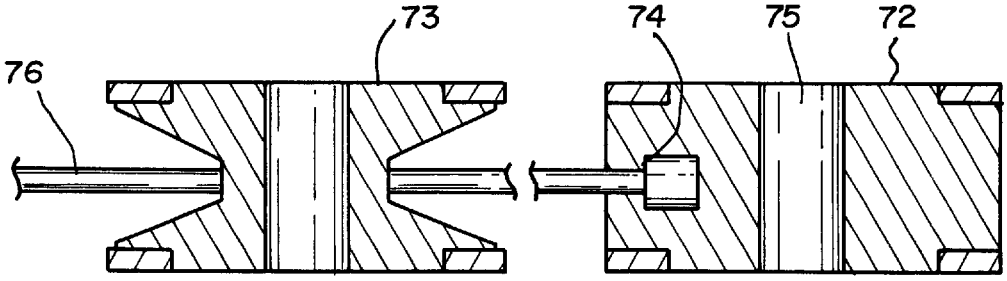
FIG. 6 is a schematic cross-sectional view along line 6—6 of the present invention.
Figure 7:
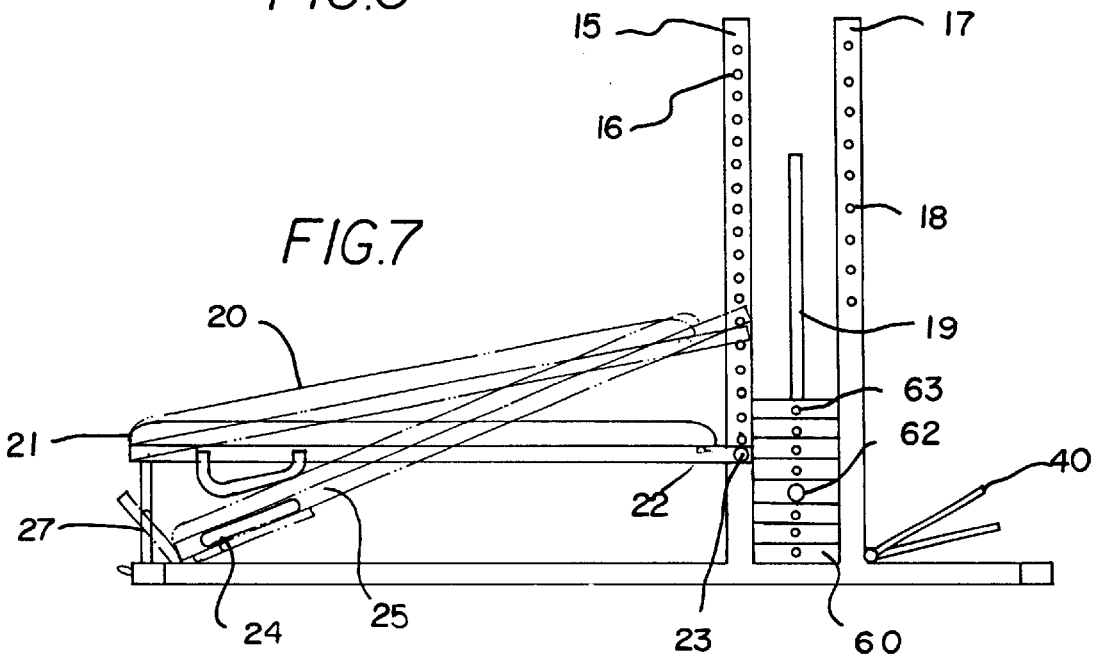
FIG. 7 is a schematic side view of the present invention.
Figure 8:
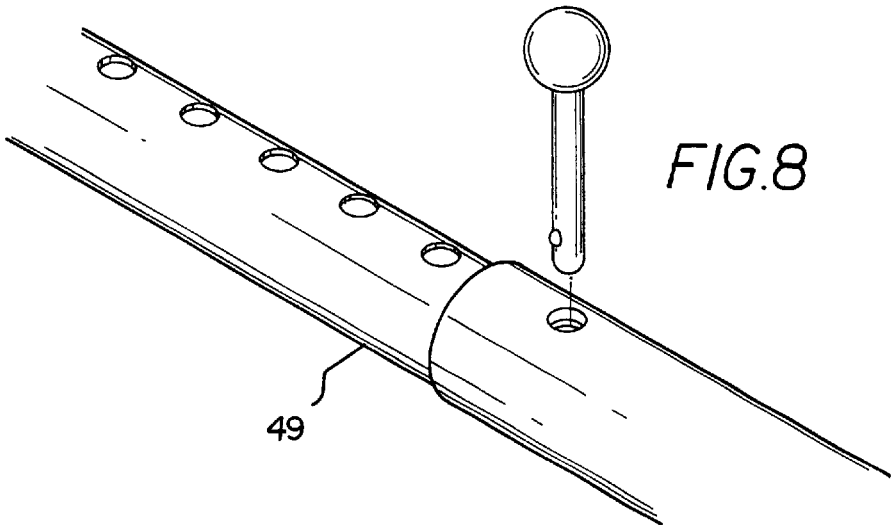
FIG. 8 is a schematic perspective view of an extendable assembly of the present invention.
Figure 9:
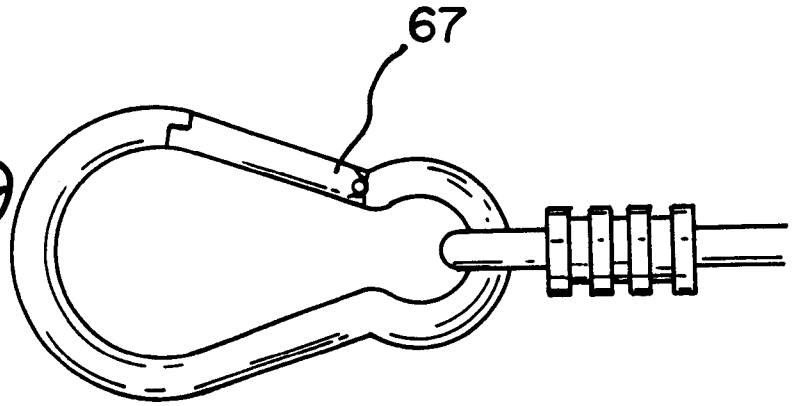
FIG. 9 is a schematic side view of a clasp of the present invention.
Figure 10:
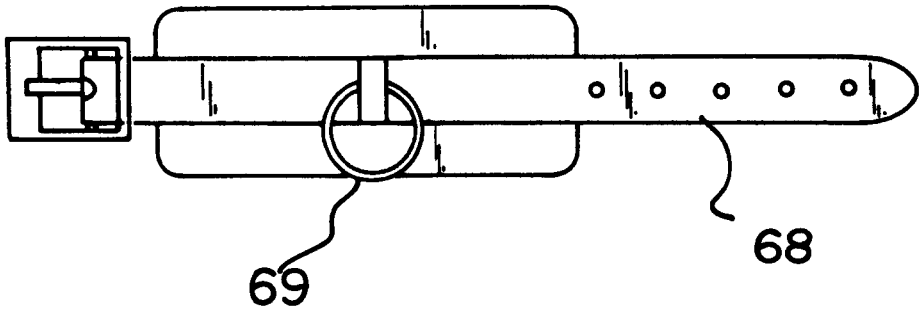
FIG. 10 is a schematic plan view of the belt of the present invention.
Figure 11:
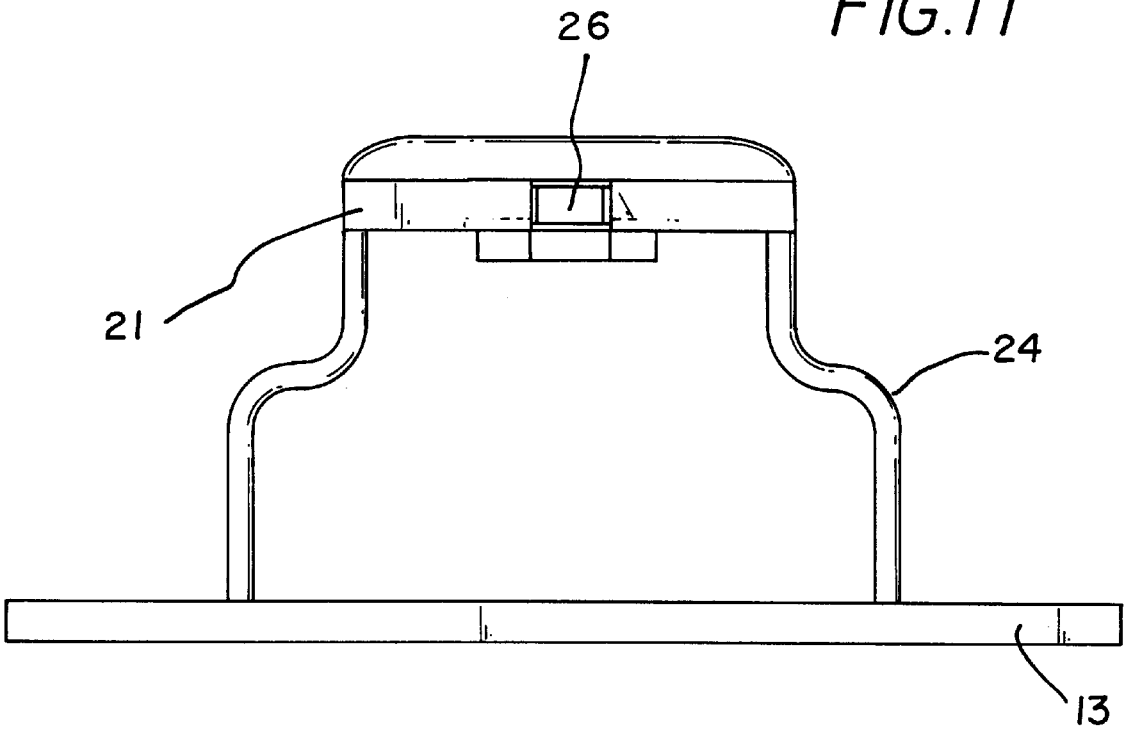
FIG. 11 is a schematic front view of the bench of the present invention.
Figure 12:
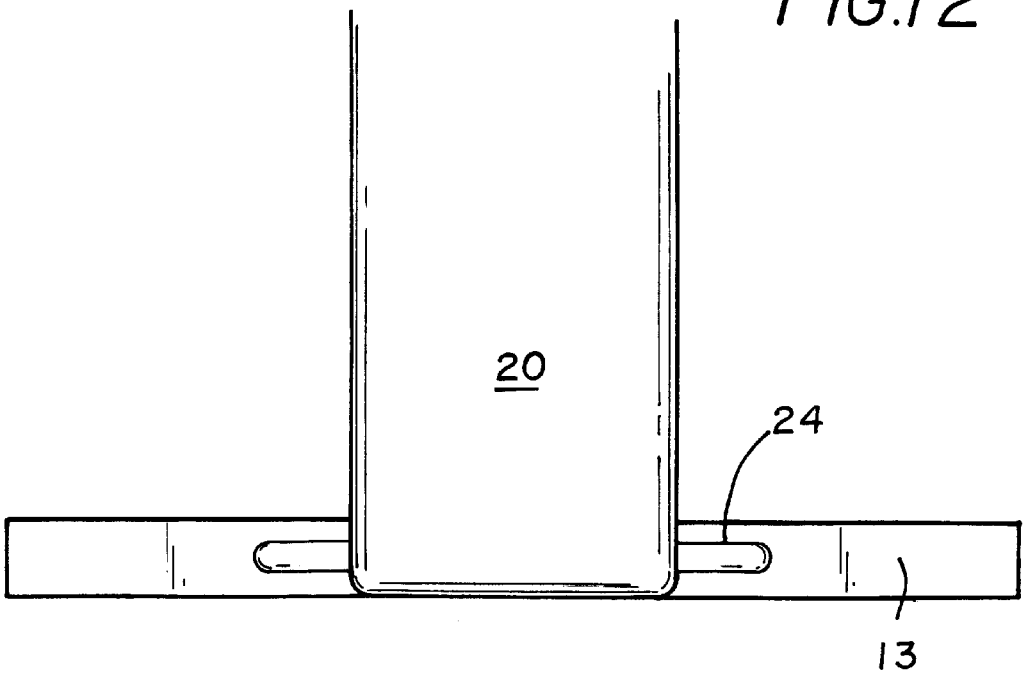
FIG. 12 is a schematic top view of the bench of the present invention.
Figure 13:
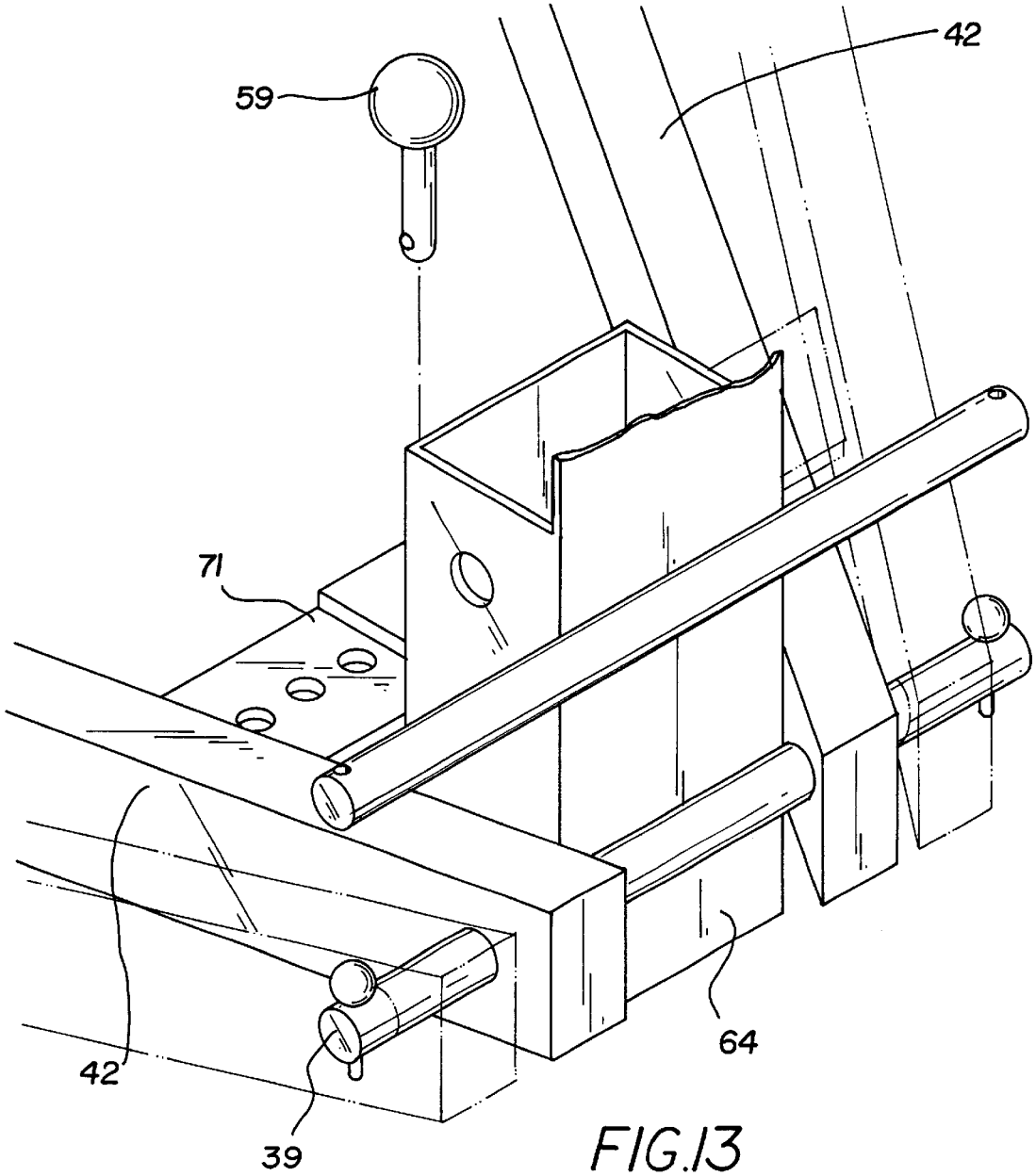
FIG. 13 is a schematic perspective view of the bottom portion of the mounting for the second set of elongate arms.

With reference now to the drawings, and in particular to FIGS. 1 through 12 thereof, a new exercise machine embodying the principles and concepts of the present invention and generally designated by the reference numeral 10 will be described.

As best illustrated in FIGS. 1 through 12, the exercise machine 10 generally comprises a horizontal I-shaped base 11. The base is hollow and has a distal end 12, a proximal end 13, and a middle portion 14.

A first vertical column 15 is fixedly attached to the middle portion of the base. The first column is perpendicular to the base and is nearer to the distal end than to the proximal end of the base. The first column has a plurality of bores 16 therein. Preferably the first column is about five inches wide.

A second vertical column 17 is fixedly attached to the base and is parallel to the first column. The second column is located between the distal end of the base and the first column to form a space between the first and second columns. The second column has a plurality of bores 18 therein. Preferably, the second column is about five inches wide.

A guide column 19 extends vertically from the base between the first column and the second column. Preferably the guide column is cylindrical in shape. The guide column has horizontal bores (not shown) perpendicular to the middle portion of the base for receiving a pin.

A bench 20 has a front end 21 and a back end 22. The back end of the bottom portion has an adjustment means 23 thereon adapted to couple the back end of the bench to the bores 16 of the first column. Preferably, the adjustment means is a two-pronged fork which will fit on either side of the first column. The prongs will each have a bore therethrough for coupling to the bores of the column with a pin.

Two legs 24 are attached to the front end of the bench 20. Each of the legs is adapted to rest on the proximal end 13 of the base. Preferably, the legs are adapted to fold against the bottom portion 25 of the bench. In this manner, the proximal portion of the base may be rested on the floor to gain greater inclination of the bench. A seat 27 is hingedly coupled to the bottom of the bench and positioned generally adjacent to the front end 21. The seat moves between an extended position and a hidden position. The extended position is achieved by flipping the seat outwardly away from the bench 20 and flipping the legs against the bottom portion 25 of the bench 20. Handlebars 28 help for stabilization of the user.

A cavity 26 is located in the front end of the bench and is rectangular in shape.

A vertical elongate member 30 has a first end 31 and a second end 32. The member is I-shaped and has an extension means 33 therein. Preferably, the member 30 is made of two portions the first 34 being hollow and the second 35 fitting inside the first. The first will have one bore in it while the second portion will have a multitude of bores which can be aligned with the bore in the first portion. A pin 36 will be placed through the bore of the first portion and into a bore of the second portion to hold the member at a desired length. The elongate member 30 has a first mounting 37 thereon adapted to be removably coupled to the cavity 26. The first mounting 37 is located adjacent to the first end 31 of the member 30 and is rotationally coupled to the member. Preferably, the ends of the member 30 have cushions 38 thereon for the comfort of the user.

A set of foot pedals 40 is attached by a hinge means 29 to the second column adjacent to the floor. The foot pedals 40 extend upwardly away from the second column 17 toward the distal end 12 of the base 11.

Preferably a support beam 41 is fixedly attached to the distal end 12 of the base and the second column 17.

A mounting 47 is slidably receivable on the first column 15. The mounting has bores therein for selectively securing the mounting to the first column 15. The mounting has a post 39 thereon.

A first set of two elongate bars 42 is adjustably mounted to a post 39 on the bottom portion 64 of the rectangular mounting 47. The bars extend outwardly away from the first column and have handles 43 on their ends. The bars 42 have a bore 44 through them on the end opposite of the handles. The bars 42 are hingedly connected by the post 39 so that they may move in vertical direction in relation to the floor. Preferably, the bars 42 can receive a third bar 45 in between the handles. The bars 42 are linked together by a linkage 71 which is able to receive a pin 59. This allows the bars 42 to be separated from each other or brought closer together.

A second set of two elongate bars 46 is adjustably mounted to the rectangular mounting 47 which is adapted for sliding down the first column 15. The rectangular mounting 47 has a bore in it so that a pin can secure it to a bore in the first column. The second set of bars 46 extend inwardly toward the second column 17 and are rotationally coupled 48 to the rectangular mounting 47 so that they rotate in a plane perpendicular to the first column 15. The arms leave the mounting parallel to the floor but then bend downward to be perpendicular to the floor. Preferably the arms can be extended 49.

A second rectangular mounting means 50 has two solid tubes 51 extending diametrically from it. The second mounting means is adapted to slide down the second column. The second mounting has a bore 52 therethrough for coupling it to a bore in the second column 17 with a pin. The tubes 51 leave the second mounting 50 in opposite directions but then bend toward each other to become parallel with one another. Ideally, the tubes 51 are rotatably mounted, not shown, to the second mounting 50 so that they will swing down to give a user of the foot pedals more area. Preferably a pull-up bar 53 is included. The pull-up bar has a first end and a second end wherein each of the ends has a cup 54 attached thereto. Each of the cups is adapted to rest on the solid tubes 51.

A pulley means is comprised of a first pulley set 55 and a second pulley set 56. The first pulley set 55 is fixedly attached to an apex of the second column 17 whereby the first pulley 55 faces the first column 15. The second pulley set 56 is fixedly attached to the first column 15 and faces the second column 17 at a height less than the first pulley set 55.

A plurality of weights 60, rectangular in shape, have a first bore 61 parallel to the guide column 19 therethrough. Each of the weights 60 is housed on the guide column 19 whereby the guide column travels through the bores in the weights. The weights are removably coupled to the guide column by a pin 62. The pin is insertable through a second bore 63 in each of the weights. The pin holds all weights above it when inserted through the second bore such that the cable, which will be mentioned below, are selectively coupled to the pin. Each of the second bores is perpendicular to the guide column.

A first cable 65 and a second cable 66, each having a first end and a second end, are drawn through the middle portion of the base. Each of the first ends of the cables are drawn out opposite sides of the proximal end 13 of the base 11. Each of the second ends of the cables is passed through the pulley means and attached to the weights such that the weights 60 may slide on said guide column 19. A third cable 57 and a fourth cable 58 are drawn through the machine and attached to the weights as are the first and second cable, however the third 57 and fourth 58 cables extend out the front side of the proximal end 13 of the base 11.

A clasping means 67 is attached to the fist ends of the cables. The clasping means is attachable to the bottom portion of the I-shaped member.

A belt 68 has a ring 69 thereon adapted for coupling to the clasping means. The belt may be placed around the user's ankles or wrists.

A pair of anchors are each linked to the pulley means 55, 56 by connector cables 76. The second ends of these connector cables 76 will be attached to the weights 60. Each of the anchors is comprised of a first disc 72 and a second disc 73. The first disc 72 is adapted to secure a first end 74 of a respective connector cable, and the second disc 73 is adapted to allow the same connector cable to slide therethrough. Each of the discs 72, 73 has a bore 75 therethrough to receive a pin.

A plurality of pins are comprised of sets of two pins wherein a first pin 77 remains motionless during movement of the apparatus and wherein a second pin 79 has movement in a direction parallel to the apparatus. The second pins move with the portions of the apparatus they are attached to. The pins are located on the foot pedals, the first set of elongate bars, and the second set of elongate bars.

In use, the user selects the desired weight by placing a pin 62 through the weight 60 desired to secure it to the guide column 19. As the cables are pulled, their attachment to the guide column will lift the weight and create resistance for the varying motions of the apparatus. If the user is going to exercise with the cables 57, 58, 66, 65 that run through the proximal end of the base, the user simply hooks those cables to either the H-shaped member 30 or onto the ring 69. The cables can also have handle attachments 70 for use with hands. The belt 68 can be secured to either the ankles or to the wrists. If the user wants to use the exercises that utilize the anchor, then the first disc 72 is placed on the stationary pin, or first pin 77, and the second disc 73 is placed on the corresponding moving pin, or second pin 79. By moving the portion of the apparatus to which the discs are attached, the weights will be lifted causing resistance to the movement. Ideally, the bench will have a mat 78 on either side of the base. The mat aids in comfort and offers a secure footing.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An exercise apparatus, comprising:

a base, said base having a distal end, a proximal end, and a middle portion;

a first vertical column wherein said first column is fixedly attached to said middle portion of said base;

a second vertical column wherein said second column is fixedly attached to said base, said second column being located between said distal end of said base and said first column to form a space between said first and second columns;

a guide column whereby said guide column extends vertically from said base between said first column and said second column;

a mounting, said mounting being slidably receivable on said first column, said mounting having bores therein for selectively securing said mounting to said first column;

a first set of two elongate bars, said first set of two elongate bars being rotatably mounted to said mounting, said first set of two elongate bars extending outwardly away from said first column;

a second set of two elongate bars being hingedly mounted to said mounting on said first column, said second set of two elongate bars extending inwardly toward said second column;

a set of foot pedals being hingedly attached to said second column, said foot pedals each extending toward said distal end of said base;

two solid tubes extending diametrically from a mounting means, said tubes bending toward each other to a parallel position, said mounting means being slidably mounted to said second column;

a pulley means, said pulley means comprising a first pulley and a second pulley, said first pulley being fixedly attached to an apex of said second column, said second pulley being attached to said first column;

a plurality of weights, each of said weights having a bore therethrough, each of said weights being housed on said guide column whereby said guide column travels through said bores in said weights, said weights being slidably coupled to said guide column;

an anchor, said anchor being coupled linked to said pulley means by a connector cable, said anchor being comprised of a first disc and a second disc, said first disc being adapted to secure said cable, said second disc being adapted to allow said connector cable to slide therethrough, said each of said discs having a bore therethrough to receive a pin; and a plurality of pins, said pins being comprised of sets of two wherein a first pin remains motionless during movement of the apparatus and wherein a second pin has movement in a direction parallel to said apparatus, said pins being located on said foot pedals, first set of elongate bars, and second set of elongate bars.

2. The exercise apparatus of claim 1, further comprising:

a bench, said bench having a bottom portion, a front end and a back end, said back end of said bottom portion having an adjustment means thereon for coupling said bench to said first column;

two legs attached to said front end of said bench, each of said legs being adapted to rest on said proximal end of said base, said legs adapted to fold against said bottom portion of said bench.

3. The exercise apparatus of claim 2, further comprising a cavity wherein said cavity is located in said front end of said bench, said cavity being rectangular in shape.

4. The exercise apparatus of claim 3, further comprising a vertical elongate member having a first end and a second end, said member being H-shaped, said elongate member having an extension means therein, said elongate member having a first mounting thereon adapted to be removably coupled to said cavity, said first end and said second end having a plurality of cushions thereon.

5. The exercise apparatus of claim 1, further comprising a support beam being fixedly attached to and extending between said distal end of said base and said second column.

6. The exercise apparatus of claim I wherein said first set of two elongate bars extend outwardly away from said first column, said bars being adapted for receiving a third bar therebetween.

7. The exercise apparatus of claim 6, further comprising a pull-up bar, said pull-up bar having a first end and a second end wherein each of said ends has a cup attached thereto, each of said cups being adapted to rest on said solid tubes.

8. The exercise apparatus of claim 4, wherein said base further comprises said base being hollow, said base containing a third cable and a fourth cable, each of said cables having a first end and a second end, each of said cables being drawn through said middle portion of said base, each of first ends of said cables being drawn out in an opposite direction of said proximal end of said base, each of said second ends of said cables being passed through said pulley means and attached to said weights.

9. The exercise apparatus of claim 8, further comprising a clasping means, said clasping means being attached to each of said first ends of each of said third and fourth cables.

10. The exercise apparatus of claim 9, further including a belt means, said belt means having a ring thereon for coupling to said clasping means.

11. An exercise apparatus, comprising:

a horizontal I-shaped base, said base being hollow, said base having a distal end, a proximal end, and a middle portion;

a first vertical column, said first column being fixedly attached to said middle portion of said base, said first column being orientated generally perpendicular to said base, said first column being nearer to said distal end of said base than to said proximal end of said base, said first column having a plurality of bores therein;

a second vertical column, said second column being fixedly attached to said base, said second column being generally orientated parallel to said first column, said second column being located between said distal end of said base and said first column to form a space between said first and second columns, said second column having a plurality of bores therein;

a guide column, said guide column being integrally coupled to said base, said guide column extending upwardly from said base between said first column and said second column;

a bench, said bench having a bottom portion, a front end and a back end, said back end of said bottom portion having an adjustment means thereon adapted to couple said back end of said bench to said bores of said first column;

two legs attached to said front end of said bench, each of said legs being adapted to rest on said proximal end of said base, said legs being hingedly coupled to said bench such that said legs are adapted to fold against said bottom portion of said bench;

a cavity, said cavity being located in said front end of said bench, said cavity being rectangular in shape;

a vertical elongate member having a first end and a second end, said vertical elongate member being H-shaped, said vertical elongate member having an extension means therein, said vertical elongate member having a first mounting thereon adapted to be removably coupled to said cavity, said first mounting being located adjacent to said first end, said first end and said second end having a plurality of cushions thereon;

a set of foot pedals being hingedly attached to said second column, each of said foot pedals extending away from said second column toward said distal end of said base;

a support beam, said support beam being fixedly attached to and extending between said distal end of said base and said second column;

a mounting, said mounting being slidably receivable on said first column, said mounting having bores therein for selectively securing said mounting to said first column, said mounting having a post thereon, said post being orientated generally perpendicular to said first column;

a first set of two elongate bars, said first set of two elongate bars being adjustably mounted to said post of said mounting, said first set of two elongate bars extending outwardly away from said first column, said first set of two elongate bars each having a handle thereon, said first set of two elongate bars each being adapted for receiving a third bar therebetween;

a second set of two elongate bars being hingedly mounted to said mounting on said first column, said second set of two elongate bars extending inwardly toward said second column;

a second mounting means, said second mounting means being slidably receivable on said first column, said second mounting means being rectangular, said second mounting means having two solid tubes extending diametrically therefrom, said tubes bending toward each other to a parallel position, said second mounting means being adapted to be mounted to said bores of said second column;

a pulley means, said pulley means comprising a first pulley and a second pulley, said first pulley being fixedly attached to an apex of said second column, said first pulley being directed towards said first column, said second pulley being fixedly attached to said first column, said second pulley being directed towards said first column, said second pulley being positioned lower than said first pulley;

a plurality of weights, each of said weights being rectangular in shape, each of said weights having a first bore therethrough, each of said first bores in said weights being parallel to said guide column; each of said weights being housed on said guide column whereby said guide column travels through said bores in said weights, said weights being removably coupled to said guide column by a pin, said pin being inserted through a second bore in each of said weights, each of said second bores being perpendicular to said guide column;

a first cable and a second cable, each of said cables having a first end and a second end, each of said cables being drawn through said middle portion of said base, each of first ends of said cables being drawn out an opposite side of said proximal end of said base, each of said second ends of said cables being passed through said pulley means and attached to said weights;

a clasping means, said clasping means being attached to each first end of each first and second cables;

a belt, said belt having a ring thereon adapted for coupling to said clasping means;

a pair of anchors, each of said anchors comprising a first disc, a second disc and a connector cable, said connector cable having a first end and a second end, said second end of said connector cable being fixedly coupled to said weights, said first disc being fixedly secured to said first end of said connector cable, said second disc being adapted to allow said connector cable to slide therethrough, each of said discs having a bore therethrough to receive a pin; and a plurality of pins, said pins being comprised of sets of two wherein a first pin remains motionless during movement of the apparatus and wherein a second pin has movement in a direction parallel to movement of said apparatus, said pins being located on said foot pedals, first set of elongate bars, and second set of elongate bars.

12. The exercise apparatus of claim 11, further comprising a pull-up bar, said pull-up bar having a first end and a second end wherein each of said ends has a cup attached thereto, each of said cups being adapted to rest on said solid tubes.

* * * * *